US005724673A

United States Patent [19]

Aldridge

[11] Patent Number: 5,724,673

[45] **Date of Patent: *Mar. 10, 1998**

[54] FIREFIGHTER GARMENT WITH LOW FRICTION LINER SYSTEM INCLUDING PATCHES

[75] Inventor: Donald Aldridge, New Carlisle, Ohio

[73] Assignee: Lion Apparel, Inc., Dayton, Ohio

[ * ] Notice: The term of this patent shall not extend beyond the expiration date of Pat. No. 5,539,928.

[21] Appl. No.: 626,502

[22] Filed: Apr. 2, 1996

Related U.S. Application Data

[62] Division of Ser. No. 151,408, Nov. 12, 1993, Pat. No. 5,539,928.

[51] Int. Cl.[6] ..... A41D 13/00

[52] U.S. Cl. ..... 2/81; 2/79; 2/93; 2/458

[58] Field of Search ..... 2/69, 79, 81, 85, 2/93, 227, 458, 97, 272

[56] References Cited

U.S. PATENT DOCUMENTS

| | | | |
|---|---|---|---|
| 4,034,417 | 7/1977 | Ellis | 2/81 |
| 4,141,082 | 2/1979 | Nakazawa et al. | 2/93 |
| 4,179,752 | 12/1979 | Fackelmann | 2/2 |
| 4,287,608 | 9/1981 | Meyer | 2/16 |
| 4,494,247 | 1/1985 | Kelly | 2/24 |
| 4,662,006 | 5/1987 | Ross, Jr. | 2/158 |
| 4,843,646 | 7/1989 | Grilliot et al. | 2/69 |
| 4,922,551 | 5/1990 | Anthes | 2/227 |
| 4,945,571 | 8/1990 | Calvert | 2/2 |
| 5,014,354 | 5/1991 | Dumont | 2/23 |
| 5,131,097 | 7/1992 | Grilliot et al. | 2/81 |
| 5,136,723 | 8/1992 | Aldridge et al. | 2/81 |
| 5,189,737 | 3/1993 | Ribicic | 2/93 |
| 5,198,280 | 3/1993 | Harpell et al. | 428/102 |
| 5,202,086 | 4/1993 | Baliga et al. | 428/225 |
| 5,246,782 | 9/1993 | Kennedy et al. | 428/421 |
| 5,297,295 | 3/1994 | Barbeau et al. | 2/96 |
| 5,299,602 | 4/1994 | Barbeau et al. | 139/420 A |
| 5,323,815 | 6/1994 | Barbeau et al. | 139/420 A |
| 5,539,928 | 7/1996 | Aldridge | 2/81 |

FOREIGN PATENT DOCUMENTS

| | | |
|---|---|---|
| 1056553 | 6/1979 | Canada . |
| 57-171755 | 10/1982 | Japan . |
| 59-026547 | 2/1984 | Japan . |
| 1162838 | 6/1989 | Japan . |

OTHER PUBLICATIONS

Globe Firefighters Suits Catalog, ©Globe Mfg. Co., 1980.

*Primary Examiner*—Diana Biefeld
*Attorney, Agent, or Firm*—Thompson Hine & Flory LLP

[57] ABSTRACT

A firefighter garment having a low friction liner system which includes an outer shell made of an abrasion resistant material, a moisture barrier layer made of a water-resistant material, a thermal barrier layer and a layer of material having high-lubricity positioned within the outer shell. In one embodiment, the high-lubricity layer is composed of a fire resistant filament yarn and is attached to the inside face of the thermal liner; that is, the face positioned next to the clothing of a wearer of the garment. In another embodiment, the layer of high-lubricity material is positioned to form a substrate for the moisture barrier and is located between the moisture barrier and outer shell. A garment having two layers of high-lubricity material, one forming an inside face of the thermal liner and the other forming an interface between the moisture barrier and outer shell, is also preferable. Alternately, the high-lubricity material is in the form of patches positioned at areas of high movement and friction on the garment, such as the shoulders and elbows of a coat, and the knees of a pant. All of the aforementioned embodiments reduced the friction between the layers of the garment, and between the garment and the wearer, thereby reducing the amount of energy expended by wearer of the garment while moving. This reduction of energy reduces the amount of stress imposed by the garment on a wearer.

14 Claims, 2 Drawing Sheets

FIREFIGHTER GARMENT WITH LOW FRICTION LINER SYSTEM INCLUDING PATCHES

This is a division of application Ser. No. 08/151,408 filed Nov. 12, 1993, now U.S. Pat. No. 5,539,928.

BACKGROUND OF THE INVENTION

The present invention relates to garments worn for protection from a hazardous environment, and more particularly, to garments worn by firefighters for protection from extreme heat, moisture and abrasion.

With the implementation of modern, heat resistant aramid fibers, such as NOMEX and KEVLAR materials (both registered trademarks of E. I. DuPont de Nemours & Co., Inc.), and moisture barrier materials made of GORE-TEX (a registered trademark of W. L. Gore & Associates, Inc.), modern day firefighter garments provide to the wearer adequate resistance to heat, flame, abrasion and moisture. Further, advancement in helmet materials and S.C.B.A (Self-Contained Breathing Apparatus) systems provide adequate protection for a firefighter from head impacts and noxious gases.

As a result, injury to the firefighter resulting from stress imposed by the hostile firefighting environment is emerging as a common type of injury. Consequently, efforts are being made to reduce the amount of stress imposed on a firefighter.

One form of stress is imposed by the environment and comprises the high heat present in most firefighting situations. Such stress is unavoidable. Another type of stress arises from the protective garments worn by a firefighter. Most firefighter garments comprise an outer shell of an aramid material, a moisture barrier made of semi-permeable membrane of GORE-TEX, and a thermal liner of an aramid batting. Such a thermal liner typically includes a face cloth of a woven aramid in a plain weave. While a garment comprising such layers possesses adequate abrasion, thermal and moisture resistance, friction between the layers of such garments hinders the ability of a firefighter to move, and increases the amount of effort required to perform a specific task. Also, a large amount of frictional stress arises from the rubbing of the face cloth against the clothing of the wearer. Accordingly, there is in need to provide a firefighter garment in which the stress resulting from such interlayer friction is reduced.

SUMMARY OF THE INVENTION

The present invention is a firefighter garment with a low friction liner system in which the friction resulting from relative movement between adjacent layers, as well as from the face cloth rubbing against the garments of the wearer, is reduced. The firefighter garment of the preferred embodiment includes an outer shell of an abrasion-resistant aramid material, a moisture barrier layer and a thermal layer. In the preferred embodiment, the low friction liner system comprises a layer of a fire resistant, high-lubricity fabric, such as filament yarn, which is positioned between the moisture barrier and the outer shell. The presence of this layer of high-lubricity fabric reduces the friction created by the rubbing of the moisture barrier against the outer shell which results from movement by the wearer, and therefore reduces the amount of energy expended by a wearer of the garment while moving.

In another embodiment, the face cloth of the thermal liner throughout the garment is made of a high-lubricity, fire resistant fabric, such as filament yarn. It has been found that the highest level of friction imposed by a firefighter garment occurs between the thermal liner face cloth and the clothing of a wearer. By interposing a face cloth of a high-lubricity material between the thermal layer and the wearer, the amount of stress generated by this high friction interface is substantially reduced.

Accordingly, it is an object of the present invention to provide a firefighter garment with a low friction liner system which substantially reduces the amount of energy required of a wearer to move while wearing the garment, and thereby reduces the amount of stress imposed by the garment on a wearer; a firefighter garment with a low friction liner system which does not sacrifice the fire and heat resistance of the garment in order to reduce the amount of stress imposed by the garment on a wearer; a firefighter garment with a low friction liner system which is relatively inexpensive to implement and fabricate, and is relative easy to maintain and clean; and a firefighter garment with a low friction liner system which is not excessively costly to fabricate.

Other objects and advantages of the present invention will be apparent from the following description, the accompanying drawings and the appended claims.

DETAILED DESCRIPTION

Figure 1:
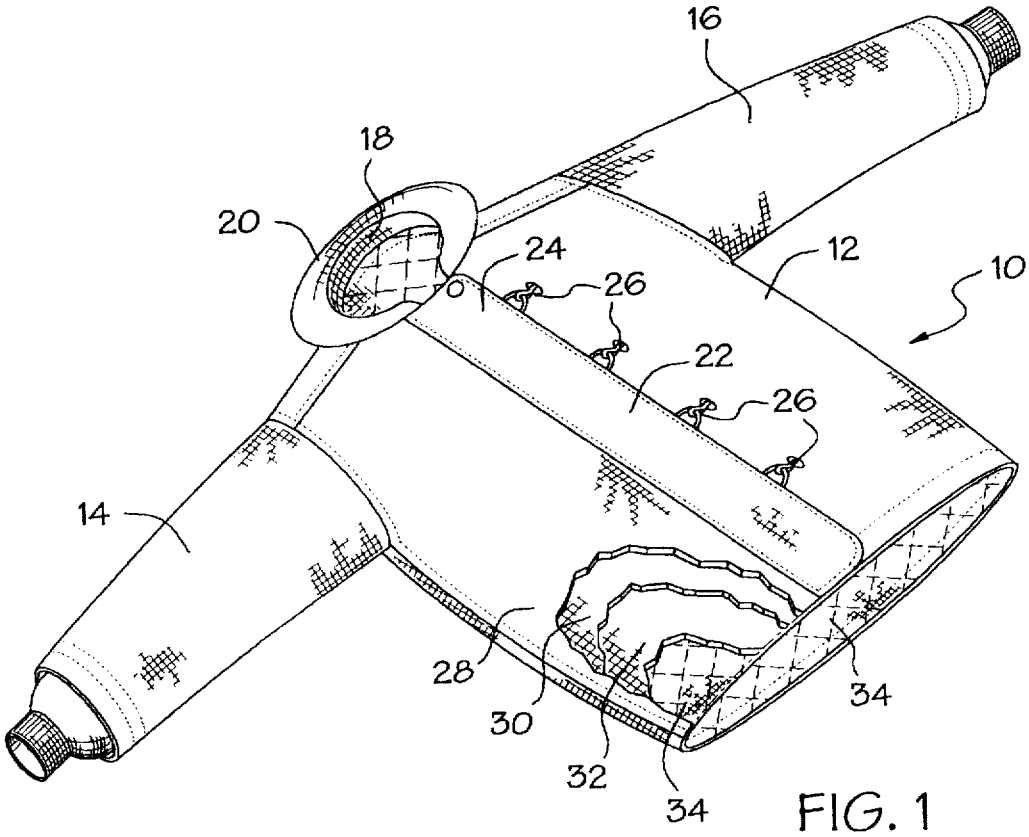
FIG. 1 is a somewhat schematic, perspective view of a firefighter garment or incorporating a liner system of a preferred embodiment of the invention.

As shown in FIG. 1, a firefighter garment of a present invention having a low friction liner system is generally designated 10 and includes a body portion 12, sleeves 14, 16, and neck opening 18, surrounded by a collar 20. It is to be understood that the garment could be in the form of another article of clothing, such as trousers (see FIG. 5), and not depart from the scope of the invention. The body portion 12 includes a front closure 22 having a slide fastener (not shown) and a flap 24 secured by "hook and D" devices 26.

Figure 2:
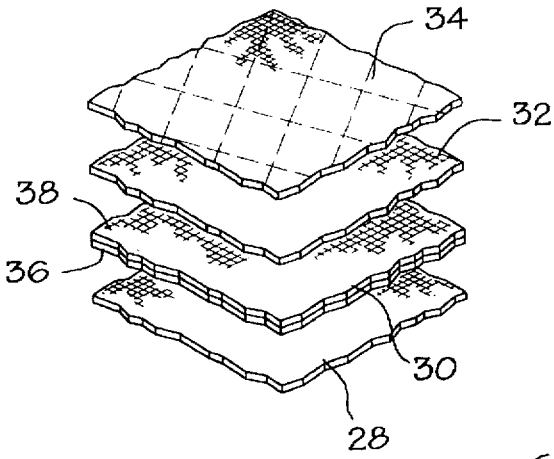
FIG. 2 is a detail showing an exploded view of the various layers of the garment of FIG. 1.

As shown in FIGS. 1 and 2, the garment 10 includes an outer shell 28 covering the entire garment and made of an aramid material such as NOMEX or KEVLAR, a moisture barrier layer 30, a thermal liner layer 32 and a face cloth layer 34. The moisture barrier layer 30 preferably includes a layer of GORE-TEX material 36 on a substrate 38 of NOMEX material. The thermal liner layer 32 preferably is a batting of aramid fibers. The face cloth layer 34 preferably is a filament yarn quilted to the thermal liner layer 32 and is made of a fire resistant material, such as NOMEX material. Other acceptable materials for the layer 34 are a combination of filament and spun, and a permanently chemically altered spun yarn having the desired degree of lubricity. The face cloth layer 34 extends throughout the garment 10, including the body portion 12 and sleeves 14, 16. The face cloth layer 34 is a plain weave, in the preferred embodiment, for lightness, but a heavier twill weave may be used since it provides less contact surface per unit area than plain or broadcloth weaves.

As a result of the presence of the high-lubricity face cloth layer 34 throughout the garment 10, the frictional forces resulting from the abrasion of the clothing of the wearer against the face cloth are significantly reduced, thereby reducing the amount of energy expended by a wearer to move while wearing the garment. This reduction in energy required for movement reduces the stress imposed upon the wearer during a firefighting situation.

Figure 3:
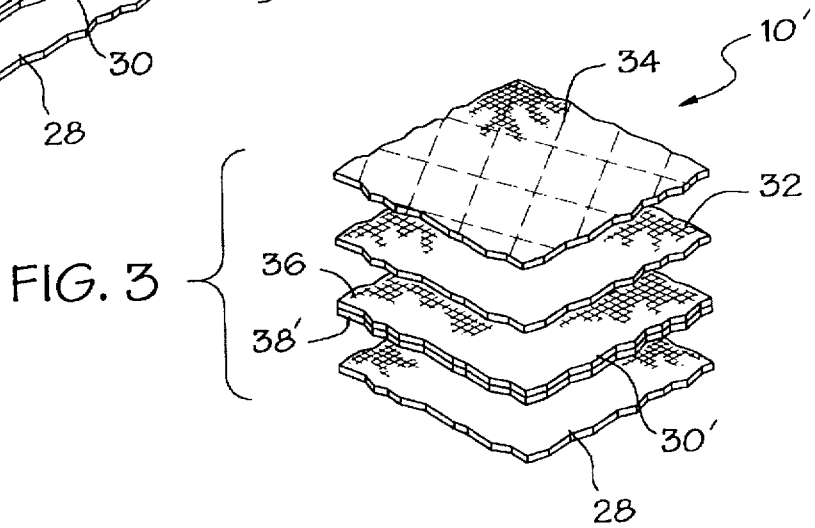
FIG. 3 is a detail, similar to that of FIG. 2, of an alternate embodiment of the invention.

An alternate embodiment of the invention 10' is shown in FIG. 3. With the embodiment 10', the low friction liner system includes an outer shell 28 of an aramid material, a moisture barrier layer 30', a thermal liner layer 32 and a face cloth layer 34 made of a high-lubricity filament yarn having fire resistant properties. Again, materials such as a combination of filament and spun or chemically altered spun yarn may be used. The moisture barrier layer 30' includes a substrate 38' which is positioned between the GORE-TEX layer 36 and the outer shell 28. The substrate 38' is bonded to the film membrane of the GORE-TEX layer 36 by a suitable adhesive. The substrate 38' is made of a high-lubricity filament yarn having fire resistant characteristics, such as an aramid fiber.

In preferred embodiment, the layers 38' and 34 extend substantially throughout the entire garment, so that frictional engagement of the outer shell and moisture barrier layers, as well as the frictional engagement between the thermal barrier and garment of the wearer, are substantially reduced. By inverting the moisture barrier 30' such that the GORE-TEX layer 36 faces thermal liner 32, a low friction interface exists between the moisture barrier and thermal liner. Consequently, with the arrangement of FIG. 3, a high-lubricity, low friction interface exists between each of the layers of the garment 10', as well as between the garment 10' and the wearer. Accordingly, with the embodiment of FIG. 3, the stress created by frictional engagement of the garment 10' with the clothing of the wearer, and internally within the garment, is minimized.

Figure 4:
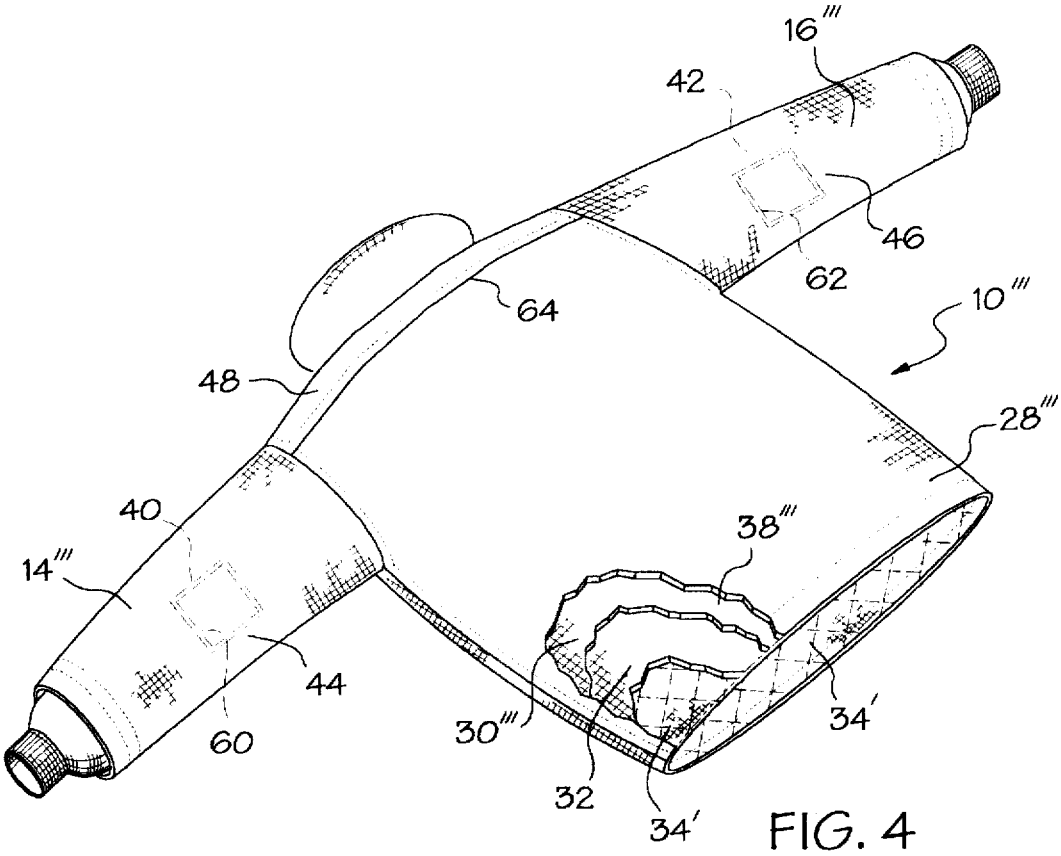
FIG. 4 is a somewhat schematic, perspective view of the reverse side of a firefighter turnout coat embodying the invention.

As shown in FIG. 4, in an alternate embodiment of the invention, the face cloth layer 34' is made of a conventional spun NOMEX material throughout the coat 10'''. Patches 40, 42 are attached by stitching on by a suitable adhesive to the face cloth layer 34' in the elbow regions 44, 46 of the sleeves 14''', 16''', and in the shoulder region 48. The patches 40, 42, 48 are each made of a spun NOMEX material having high-lubricity characteristics. This construction reduces friction in areas of relatively high movement of the wearer, so that the benefits of the invention can be effected at an overall cost which is less than for a coat having a face cloth made entirely of a spun NOMEX material.

Figure 5:
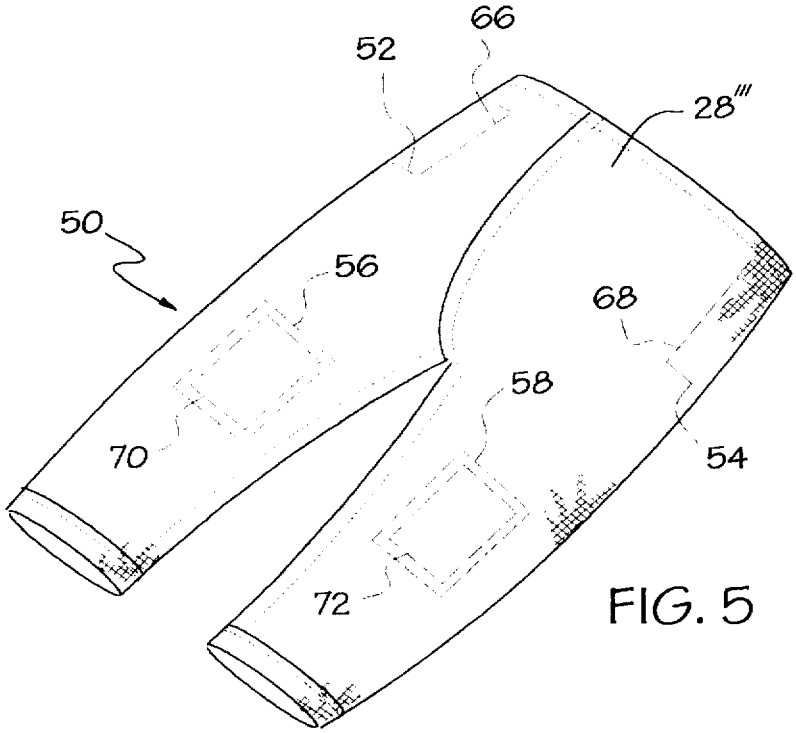
FIG. 5 is a somewhat schematic, perspective view of a firefighter pant embodying the invention.

As shown in FIG. 5, in an alternate embodiment of the invention, a firefighter pant 50, being made of the same lamination of materials as the coat 10''' shown in FIG. 4 includes hip and knee patches 52, 54, 56 and 58, respectively attached to the face cloth layer (not shown). Patches 52–58 are made of a spun NOMEX material which possesses high-lubricity and low friction characteristics, thereby reducing friction between the wearer and the garment at those areas of relatively high friction.

Similarly, as shown in FIGS. 4 and 5, patches 60, 62, 64, 66, 68, 70 and 72 may be applied to the outwardly-facing substrates 38''' of the moisture barrier layers 30''' of those garments (moisture barrier layer 30''' not shown in FIG. 5). Such patches reduce interlayer friction between the outer shells 28''' and the moisture barrier layers 30''' of those garments.

While the forms of the apparatus herein described constitute preferred embodiments of this invention, it is to be understood that the invention is not limited to these precise forms of apparatus, and that changes may be made therein without departing from the scope of the invention.

What is claimed is:

1. A firefighter garment of a type including a firefighter pant comprising:

an outer shell layer of fire and abrasion resistant material;

a moisture barrier layer positioned within said outer shell;

a thermal barrier layer positioned within said outer shell adjacent to said moisture barrier layer and including a face cloth layer;

patches having high-lubricity and forming low friction interfaces between selected adjacent ones of said layers of said pant.

2. The garment of claim 1 wherein said patches are positioned at hip and knee areas of said pant.

3. The garment of claim 1 wherein said patches are attached to said moisture barrier layer.

4. The garment of claim 1 wherein said patches are attached to said face cloth layer.

5. The garment of claim 4 wherein said patches are applied to an outwardly facing side of said moisture barrier to reduce interlayer friction.

6. A firefighter garment having a body portion and a pair of sleeves extending from said body portion, comprising:

an outer shell layer of fire and abrasion resistant material;

a moisture barrier layer positioned within said outer shell;

a thermal barrier layer positioned within said outer shell adjacent to said moisture barrier layer; and at least one patch positioned adjacent to at least one of said outer shell, moisture barrier layer and thermal barrier layer, said patch made of high-lubricity material and forming a low friction interface between selected adjacent ones of said layers of said garment.

7. The garment of claim 6 wherein said patch is positioned at areas of high movement of a wearer relative to the garment.

8. The garment of claim 7 wherein said areas include elbow and shoulder areas of said garment.

9. The garment of claim 6 wherein said at least one patch is applied to an outwardly facing side of said moisture barrier to reduce interlayer friction.

10. The firefighter garment of claim 6, further comprising a layer of facecloth material positioned within said outer shell layer, said moisture barrier layer, and said thermal barrier layer.

11. A firefighter garment having a body portion adapted to cover and protect a portion of a wearer's body, said body portion comprising:

an outer shell layer of fire and abrasion resistant material;

a moisture barrier layer positioned within said outer shell layer;

a thermal barrier layer positioned within said outer shell layer adjacent to said moisture barrier layer; and at least one patch positioned within an inner-most layer of said body portion, said patch being made of a high-lubricity material and forming a low friction interface between the garment and a wearer of the garment.

12. The firefighter garment of claim 11, wherein:

said inner-most layer is a layer of facecloth material; and said patch is positioned within said layer of facecloth material.

13. A firefighter garment having a body portion adapted to cover and protect a portion of a wearer's body, said body portion comprising:

a plurality of layers of protective materials; and at least one patch attached to at least one of said layers and positioned between two of said layers, said patch made of high-lubricity material and forming a low friction interface between said two of said layers of said garment.

14. A firefighter garment having a body portion adapted to cover and protect a portion of a wearer's body, said body portion comprising:

a plurality of layers of protective materials; and at least one patch positioned within an inner-most layer of said body portion, said patch being made of a high-lubricity material and forming a low friction interface between the garment and a wearer of the garment.

* * * * *